US005372443A

United States Patent [19]

Borucki, Jr. et al.

[11] Patent Number: 5,372,443

[45] Date of Patent: Dec. 13, 1994

[54] ADJUSTABLE PLATEN FOR LABEL PRINTER

[75] Inventors: Lawrence R. Borucki, Jr., Oostburg; Robert L. Schanke, New Berlin, both of Wis.

[73] Assignee: Brady USA, Inc., Milwaukee, Wis.

[21] Appl. No.: 138,160

[22] Filed: Oct. 15, 1993

[51] Int. Cl.[5] ..... B41J 11/02

[52] U.S. Cl. ..... 400/649; 400/656; 400/648

[58] Field of Search ..... 400/247, 656, 657, 660, 400/660.2, 645.1, 645.5, 645, 647, 648, 649

[56] References Cited

U.S. PATENT DOCUMENTS

| | | | |
|---|---|---|---|
| 4,227,819 | 10/1980 | Manriquez | 400/656 |
| 4,285,604 | 8/1981 | Rex | 400/247 |
| 4,410,291 | 10/1983 | Speraggi | 400/247 |
| 4,439,777 | 3/1984 | Aprato | 400/656 |
| 4,444,522 | 4/1984 | Suzuki et al. | 400/247 |
| 4,483,633 | 11/1984 | Kosner, Jr. et al. | 400/649 |
| 4,660,471 | 4/1987 | Wright, Jr. et al. | 101/219 |
| 4,680,081 | 7/1987 | Hamisch, Jr. | 156/384 |
| 4,768,894 | 9/1988 | Suzuki et al. | 400/656 |
| 4,820,064 | 4/1989 | Sato et al. | 400/120 |
| 4,843,338 | 6/1989 | Rasmussen et al. | 346/140 |
| 4,883,375 | 11/1989 | Karube et al. | 400/55 |
| 4,966,476 | 10/1990 | Kuzuya et al. | 400/208 |
| 4,985,909 | 1/1991 | Bjoerk et al. | 378/173 |
| 5,085,533 | 2/1992 | Kitahara et al. | 400/652 |
| 5,106,213 | 4/1992 | Martinez et al. | 400/120 |
| 5,118,208 | 6/1992 | Kitahara et al. | 400/56 |
| 5,180,235 | 1/1993 | Saito | 400/167 |
| 5,212,499 | 5/1993 | Hongo et al. | 346/76 |

OTHER PUBLICATIONS

Photo of printer assembly, Epson Printhead.

Photos of label printer of Brady, LS 2000, Views 1, 2, 3.

Manual, Brady LS2000 Labeling System, pp. 8 and 44.

*Primary Examiner*—Edgar S. Burr

*Assistant Examiner*—Lynn D. Hendrickson

*Attorney, Agent, or Firm*—Quarles & Brady

[57] ABSTRACT

A printer assembly that can handle media of different width and thicknesses has a pivotable platen with a lower body portion and a curved upper portion which extends from the lower portion. The curved portion is pivoted forward to contact the carrier material. A wound torsion spring, with one end held against a stop and the other end free to move the platen, is utilized to urge the platen in a forward direction to contact the carrier strip. The spring pressure is sufficient to keep the platen from being moved by the force of printing elements striking the material to be printed on. The assembly is also provided with spring-mounted edge guides for handling different widths of printing media to be fed through the printer assembly.

6 Claims, 2 Drawing Sheets

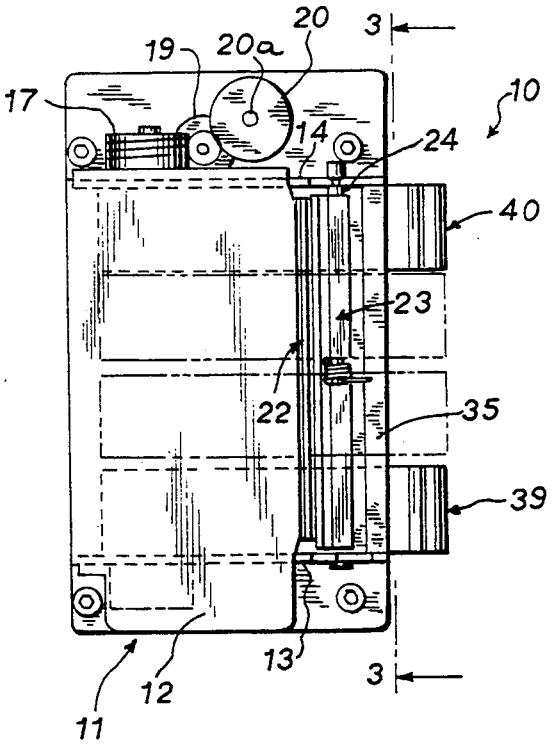
FIG. 1
FIG. 2
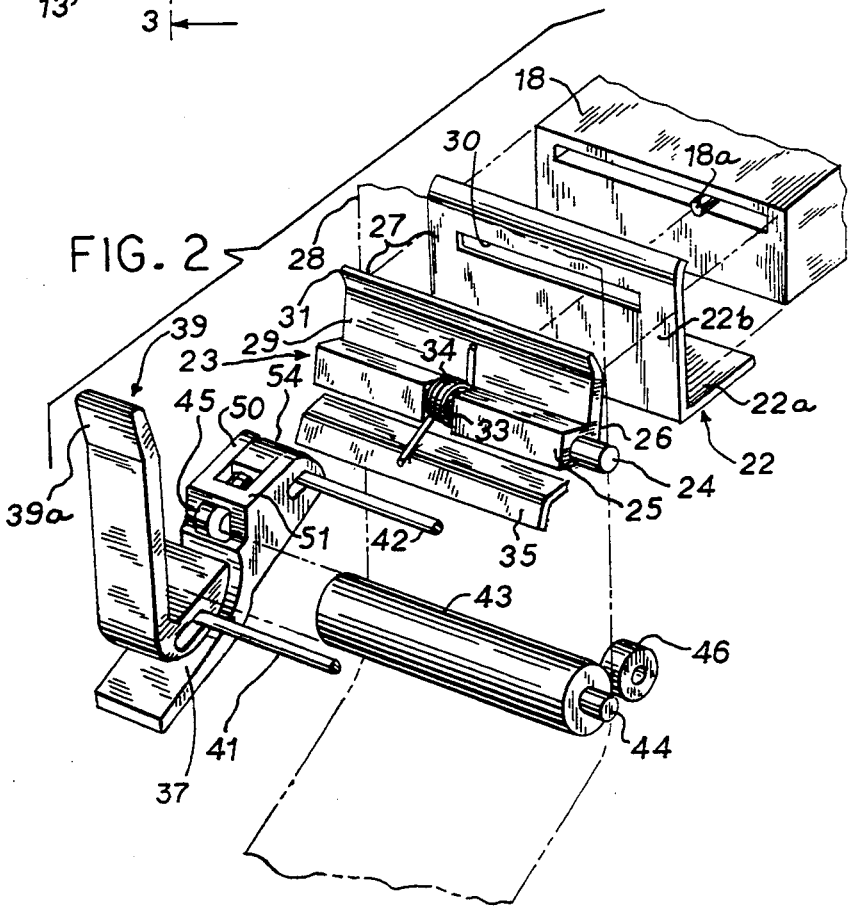

FIG. 3
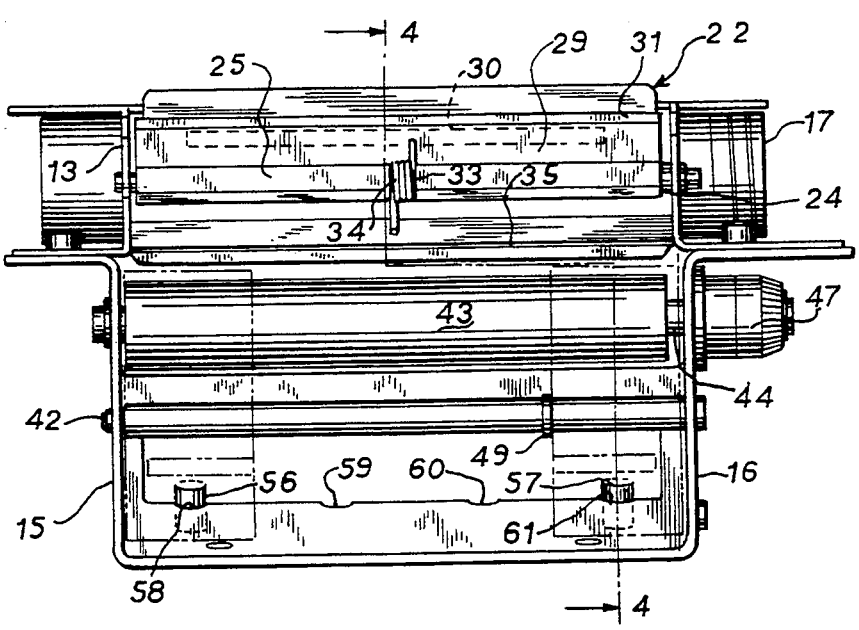
FIG. 4
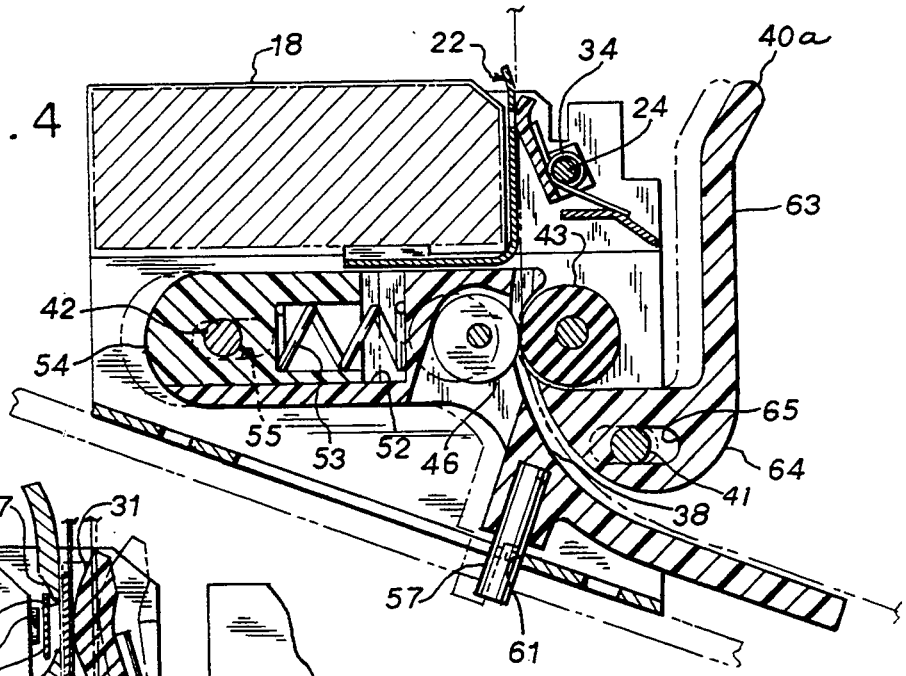
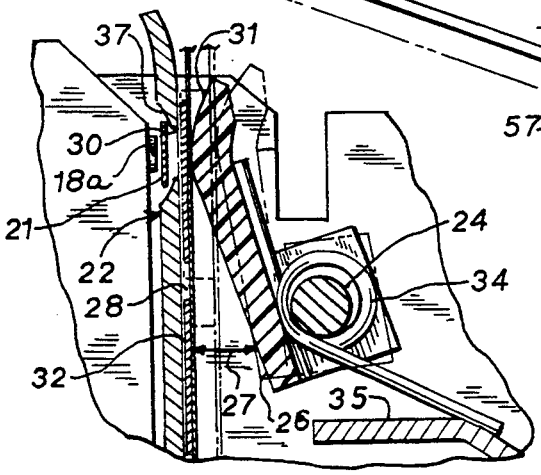
FIG. 5

ADJUSTABLE PLATEN FOR LABEL PRINTER

TECHNICAL FIELD

The invention relates to printers of the type used with computer or microprocessor-controlled equipment, and more particularly relates to an adjustable platen for a handheld printer for labels and other material to be printed on.

BACKGROUND ART

The invention involves a modification to a commercially available printer assembly. The assembly has a dot matrix type printing element, of relatively small size, for handling labeling media. The labeling media comprises a series of labels that are attached to a carrier strip. The carrier strip is fed through the printer and legends are printed on the labels. The labels are then removed from the carrier and attached to the objects needing identification.

Typically, the carrier for the labels is smaller than letter-sized paper. The carrier, or the carrier and labels in combination, are typically thicker than ordinary paper. As there are many types of label applications, it is desirable to have a printer assembly that can handle media of different width and thicknesses.

One known prior label printer has a movable platen, which can handle thicker media, provided that a manual adjustment is operated to change the gap between the platen and the printhead. Power to the machine must be turned off, and a cover must be opened to make the adjustment.

Rasmussen, U.S. Pat. No. 4,833,338, shows a plate-type platen, as opposed to a roller, which is biased by compression springs, so as to be urged farther away from the printer when thicker media is fed between the platen and the printhead. This ink jet printer has a different configuration than a dot matrix type printhead, and simply provides a platen plate that is slideable against the force of two compression springs. This would not provide the features desired for a handheld label printer.

SUMMARY OF THE INVENTION

The invention relates to a platen that supports a printing medium from behind, while a dot matrix printing element is moving forward to make an impression on labels, wire markers or other small objects to be printed on. The platen is spring-biased to rotate forward and set the gap through which the printing medium is fed.

The platen of the invention is notable in that it is not a roller, which is often seen in the prior art. The platen has a platen body, and a platen flap extending from the platen body towards the mask slot, the platen flap having a curved upper end for positioning against a back side of the printing medium, such that when the platen is pivoted forward to support a printing medium, said upper end presents a surface that is substantially perpendicular to the path of the printing element, the platen flap being pivotable between a position forming an acute angle with the mask and a position substantially parallel to the mask to adjust the print gap to handle printing media of different thicknesses.

The platen is urged towards the mask slot to adjust for different thicknesses of printing media and to provide sufficient support behind the printing medium as it is being struck by the printhead elements through the printing ribbon.

Preferably, the urging means is a wound torsion spring, with one end held against a stop and the other end free to move the platen. By providing a slot in the platen, the torsion spring can be wound around a support rod for pivotably mounting the platen. This provides a compact arrangement in which only a single spring is necessary for urging the platen into contact with the printing medium.

The platen works in conjunction with a stationary mask. The mask sets and keeps the distance between the printhead and material being printed on. The mask has a horizontal slot through which the printing elements move to strike the ribbon and the material being printed on. A groove is formed over the slot from the printhead side to reduce the thickness of the mask in the area of the slot for proper operation of the printhead and ribbon.

Other objects and advantages, besides those discussed above, will be apparent to those of ordinary skill in the art from the description of the preferred embodiment which follows. In the description, reference is made to the accompanying drawings, which form a part hereof, and which illustrate examples of the invention. Such examples, however, are not exhaustive of the various embodiments of the invention, and, therefore, reference is made to the claims which follow the description for determining the scope of the invention.

BRIEF DESCRIPTION OF THE DRAWINGS

FIG. 1 is a top view of a portion of a printer employing the platen assembly of the present invention;

FIG. 2 is an exploded perspective view of the assembly in FIG. 1;

FIG. 3 is an front view in elevation of the assembly of FIGS. 1 and 2;

FIG. 4 is a sectional view taken in the plane indicated by line 4—4 in FIG. 3; and FIG. 5 is a detail view of a portion of the assembly of FIG. 4.

DETAILED DESCRIPTION OF THE PREFERRED EMBODIMENT

FIG. 1 illustrates an assembly 10 that incorporates the platen assembly of the present invention. The assembly 10 includes a printer subassembly 11. The printer subassembly 11 is an Epson Model M-150-II, which has been modified for use with the present invention. The printer subassembly 11 has a frame with a top cover 12, upper left and upper right sidewalls 13, 14 and lower left and lower right sidewalls 15, 16 as seen in FIG. 3. The printer subassembly 11 has a shuttle-type dot matrix printhead 18 seen in FIG. 2. The printhead 18 has one or more printing elements 18*a*.

Other parts of the printer assembly 11 include a worm drive gear 17 (FIG. 1) for driving a gear train that includes spur gears 19, 20. Spur gear shaft 20*a* drives a print ribbon 21 (FIG. 5) that is contained in a conventional print ribbon cartridge (not shown), which has been removed for a better view of the structure of the invention.

As seen in FIG. 2, the printer assembly 11 has been provided with a fixed mask 22 and a pivotable platen 23 that adjusts to different thicknesses of material 28 being fed between the mask 22 and the platen 23. A support rod 24 for the platen 23 is mounted in sidewalls 13, 14

(FIGS. 1, 2, 3) and spaced from the mask 22, the support rod 24 extending substantially parallel to the mask 22.

The platen 23 (FIGS. 2, 5) includes a body portion 25 having four flat sides, with one side 26 facing the mask 22. The platen body 25 is supported for pivoting action by the support rod 24, the platen body 25 having flat side 26 spaced from the mask 22 to provide a gap 27 (FIGS. 2, 5) for receiving the carrier 28 and objects 32 to be printed on. The platen 25 further includes a platen flap 29 extending from flat side 26 of the platen body 25 towards a mask slot 30. The platen flap 29 has a curved upper end 31 for positioning against a back side of the carrier 28, the platen flap 29 being pivotable from a position forming an acute angle with the mask 22 (FIG. 5) to a position substantially parallel to the mask 22 to increase the width of the gap 27 to handle media thicker than carrier 28.

The body 25 of the platen 23 could be other shapes than rectangular in cross section. It could be round, for example. The upper end 31 of the platen flap 29 is curved, with reference to the axis of pivoting the platen 23, such that when the platen 23 is pivoted forward to support a printing medium, a surface is presented that is substantially perpendicular to the path of the printing element 18*a*.

The platen body 25 (FIG. 2) forms an opening 33 midway between opposite ends of the platen body 25, the opening 33 exposing a portion of the support rod 24 where a torsion spring 34 is coiled around the support rod 24 within the opening 33.

A cross support member 35 (FIG. 2) is mounted to the frame of the printer subassembly 11 and provides a stop for one end of the torsion spring 34. An opposite, free end of the torsion spring 34 bears against the back side of the platen flap 29 to urge it into contact with the back side of the carrier 28 as seen best in FIG. 5. The pressure from the torsion spring 34 and the inertia of the platen 23 is sufficient to keep the platen 23 from being moved by the force of printing elements 18*a* striking through the ribbon 21 on the objects 32 to be printed on.

The mask 22 (FIG. 2) has a base 22*a* and an upright wall 22*b* running parallel to the platen 23. A horizontal mask slot 30 (FIGS. 2, 5) is provided so that printing element 18*a* can be reciprocated through the slot 30 to make an impact through the printing ribbon 21 upon the objects 32 to be printed on. The print elements 18a are also moved from side to side to locate characters on the labels, wire markers or other objects that may be printed on.

The mask 22 (FIG. 5) sets and maintains the distance between the printer 18 and the objects 32 being printed on. The mask 22 is preferably made of a stainless steel material of approximately 0.019 inches thickness. The stroke of the printing elements is approximately 0.030 inches. A groove 37 (seen in section in FIG. 5) is milled along the top and bottom of the slot 30 from the printhead side to reduce the thickness of the mask 22 in the area of the slot 30 to a thickness in the range of 0.005 inches to 0.010 inches. The ribbon 21 moves in the area of this grooved slot 30 during operation. The grooved slot 30 assures proper operation of the printhead elements 18*a* and good contact of the ribbon 21 on the objects 32.

The carrier 28 is fed into the bottom of the gap 27 between the mask 22 and the platen 23 through a curved track provided by grooves 37, 38 (FIGS. 2, 4) formed in a pair of edge guide assemblies 39, 40. Edge guide assemblies 39, 40 (FIG. 1) are spaced laterally apart and are mounted on two traverse rods 41, 42 (FIG. 2) spaced one in front of the other. The carrier 28 is moved by a feed roller 43 (FIG. 2), which is mounted on an axle 44 for rotation in the lower sidewalls 15, 16. The edge guide assemblies 39, 40 mount smaller nip rollers 45, 46 (FIG. 2), which are held with spring pressure against the main feed roller 43 for the carrier 28. The gear 47 (FIG. 3) is engaged by an external drive to drive the feed roller 43.

The edge guide assemblies 39, 40 (FIGS. 1, 2) are also made to be moved laterally on the traverse rods 41, 42 to adjust for different widths of carrier strips 28. While one edge guide assembly 39, 40 is a mirror of the other and has similar parts, the right edge guide assembly 40 is prevented from moving laterally on traverse rods 41, 42 by stop 49 (FIG. 3). Each edge guide assembly 39, 40 has an integrally molded base, 39*a*, 40*a*, in which one of the curved grooves 37, 38 is formed for accepting one edge of the carrier 28. Each edge guide assembly 39, 40 also has a pair of spaced apart fingers 50, 51 (FIG. 2) forming a spring cage 52 (FIG. 4) for a compression spring 53 (FIG. 4). The compression spring 53 (FIG. 4) is located therein and contained by a spring loader 54 fitting between the fingers 50, 51 and being slidingly mounted on traverse rod 42. Base 39*a* is mounted on rod 42 by slot 55, so that the base 39*a* can be moved inward. Each edge guide assembly 39, 40 also has a web 63 (shown in FIG. 4 for assembly 40) with a foot 64 having a slot 65 in which front traverse rod 41 slides to support the outward portion of the edge guide assembly 39, 40, while allowing the assemblies 39, 40 to move in and out relative to the feed roller 43. This movement causes the spring 53 to be compressed. Normally, the extension of the spring 53 causes stem 56 (FIG. 3) to be held in one of three notches 58, 59, 60 (FIG. 3) while stem 57 is held in notch 61 (FIG. 4). When stem 56 is manually moved out of notch 58, edge guide assembly 39 can be moved to width positions seen in FIG. 1 that correspond to notches 59 and 60 in FIG. 3. The movement of stems 56, 57 out of notches 57 and 60, respectively, also releases the frictional grip on the carrier 28 between nip rollers 45, 46 and main feed roller 43. As seen in FIG. 4, stem 57 extends downward from the base 40*a* for manually moving the edge guide assembly 40 inward to release the carrier 28.

A roll of labels on a carrier is placed into the roll holder area and manually pushed into grooves 37 and 38, until resistance is felt from rolls 43 and nip rollers 45, 46. The feed roller is then actuated and pushes material up into gap 27 and up into area where the pint slot 30 is. The advancing is continued until material extends beyond platen flap 29.

This has been a description of examples of how the invention can be carried out. Those of ordinary skill in the art will recognize that various details may be modified in arriving at other detailed embodiments, and these embodiments will come within the scope of the invention.

Therefore, to apprise the public of the scope of the invention and the embodiments covered by the invention, the following claims are made.

We claim:

1. A platen assembly for supporting a back side of a printing medium that carries objects to be printed on by a printing element in a printer assembly, the printer assembly forming a stop for the platen assembly, and the platen assembly comprising:

a stationary mask having a mask slot through which a printing element moves to print on the objects;

a platen including a platen body, the platen also including a platen flap extending from the platen body towards the mask slot, means for mounting the platen for pivotal movement around an axis substantially parallel to the mask, the platen flap having a curved upper end for positioning against a back side of the printing medium, such that when the platen is pivoted forward to support a printing medium, said upper end presents a surface that is substantially perpendicular to the path of the printing element, the platen flap being pivotable between a position forming an acute angle with the mask and a position substantially parallel to the mask to adjust the print gap to handle printing media of different thicknesses; and means for urging the platen flap into supporting contact with the back side of the printing medium, said urging means being yieldable to allow different thickness of printing media to be fed into the print gap.

2. The platen assembly of claim 1, wherein the urging means is a wound torsion spring with one end held against the stop on the printer assembly and another end bearing against the back of the platen for urging the platen flap into supporting contact with the back side of the printing medium.

3. The platen assembly of claim 1, wherein the body of the platen forms a slot midway between opposite ends of the platen body, the slot exposing the support rod, and wherein the torsion spring is positioned within the slot.

4. The platen assembly of claim 3, wherein the means for mounting is a support rod and wherein the torsion spring is coiled around the support rod.

5. The platen assembly of claim 3, wherein the wound torsion spring is the only spring used to urge the platen against the printing medium.

6. The platen assembly of claim 1, wherein the mask includes a slot running transversely from side to side across the printing medium, and wherein a groove is superimposed on said slot to reduce the thickness of the mask in an area in which a printing ribbon is fed transversely and urged against the printing medium by at least one printing element in a printer assembly.

* * * * *